US007315628B2

(12) United States Patent
Kuribayashi et al.

(10) Patent No.: US 7,315,628 B2
(45) Date of Patent: Jan. 1, 2008

(54) DIAPHRAGM FOR LOUD SPEAKER AND LOUD SPEAKER EMPLOYING IT

(75) Inventors: Ryo Kuribayashi, Matsusaka (JP); Shinsaku Sawa, Matsusaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 248 days.

(21) Appl. No.: 10/528,780

(22) PCT Filed: Oct. 14, 2004

(86) PCT No.: PCT/JP2004/015553

§ 371 (c)(1),
(2), (4) Date: Mar. 22, 2005

(87) PCT Pub. No.: WO2005/036923

PCT Pub. Date: Apr. 21, 2005

(65) Prior Publication Data

US 2006/0062421 A1 Mar. 23, 2006

(30) Foreign Application Priority Data

Oct. 15, 2003 (JP) ..... 2003-354832

(51) Int. Cl.
*H04R 25/00* (2006.01)

(52) U.S. Cl. ..... 381/424; 381/423

(58) Field of Classification Search ..... 381/398, 381/423, 424, 426, 432; 181/157, 163, 164, 181/165, 167, 171, 172, 173, 174
See application file for complete search history.

(56) References Cited

U.S. PATENT DOCUMENTS

| | | | | |
|---|---|---|---|---|
| 6,026,929 | A * | 2/2000 | Faraone | 181/173 |
| 6,863,153 | B1 * | 3/2005 | Hayakawa et al. | 181/173 |
| 2005/0078850 | A1 * | 4/2005 | Norton | 381/423 |

FOREIGN PATENT DOCUMENTS

| | | |
|---|---|---|
| JP | 53-119023 | 10/1978 |
| JP | 55-147898 | 11/1980 |
| JP | 6-149594 | 6/1996 |
| JP | 11-075290 | 3/1999 |
| JP | 2000-308178 | 11/2000 |

* cited by examiner

*Primary Examiner*—Huyen Le
(74) *Attorney, Agent, or Firm*—Steptoe & Johnson LLP

(57) ABSTRACT

The present invention provides a diaphragm for a loudspeaker which suppresses divided resonance and shows a stable sound-pressure-frequency characteristic, and a loudspeaker using the diaphragm. The diaphragm includes three or more thick parts (11*c*) of odd numbers formed radially from a center part to an outer periphery, and semi thick part (11*d*) formed between the thick parts so as to become thinner gradually from the outer periphery to the center part. Web shaped thin part (11*e*) is formed at an inner part of the semi thick part.

5 Claims, 6 Drawing Sheets

PRIOR ART

DIAPHRAGM FOR LOUD SPEAKER AND LOUD SPEAKER EMPLOYING IT

This application is a U.S. national phase application of PCT international application PCT/JP2004/015553.

TECHNICAL FIELD

The present invention relates to a diaphragm for a loudspeaker used in various acoustic devices and a loudspeaker using the diaphragm.

BACKGROUND ART

A conventional diaphragm for a loudspeaker (hereinafter referred to as "diaphragm") is demonstrated hereinafter with reference to FIGS. 5 through 7. FIG. 5 is a half sectional side view of the conventional loudspeaker. FIG. 6 is a half sectional side view of the conventional diaphragm. FIG. 7 is a plan view of the conventional diaphragm shown from its bottom.

As shown in the drawings, magnetic circuit 5 is formed of yoke 2, disk shaped magnet 3 and top plate 4. Yoke 2, which is made of magnetic material, has a cylindrical outer wall and protrudes a center of its bottom upward.

Magnetic gap 5*a* is formed between a circular inside of the outer wall of yoke 2 and an outer circumference of top plate 4. Neodymium or ferrite base magnet is generally used as magnet 3.

Resin frame 7 is coupled with an outer circumference of yoke 2. A known means such as adhesive, press fitting or outsert molding to resin frame 7 is used as the coupling with yoke 2.

Cone shaped diaphragm 1, which is formed of main body 1*a* of the diaphragm and edge 1*b* of an outer circumference, is formed by resin-molding with its thickness thin. An outer circumference of edge 1*b* is bonded to frame 7, and an inner circumference of main body 1*a* of the diaphragm is bonded to voice coil 6.

Voice coil 6 is held by suspension 8 in such a manner that coil 6*a*, which is formed at a lower end of voice coil 6, is kept in magnetic gap 5*a*.

An outer circumference of suspension 8 is bonded to frame 7, and an inner circumference thereof is bonded to voice coil 6. Dust cap 9 prevents a foreign body from entering into magnetic circuit 5.

According to the loudspeaker constructed above, an audio signal is input from the outside (not shown) to coil 6*a* of voice coil 6, whereby voice coil 6 moves vertically by Fleming's left-hand rule based on the audio signal. Then diaphragm 1 moves vertically, so that a sound is emitted.

This kind of loudspeaker is disclosed in Unexamined Japanese Patent Publication No. H8-149594.

Recently, high sound quality has been required for various acoustic devices, and diaphragm 1 has been required to be lighter for improving sound pressure. However, the following problems may occur by merely reducing a thickness of diaphragm 1 or using material having a low density for reducing weight. In a word, because an elastic modulus of the diaphragm decreases, divided resonance tends to occur at the diaphragm. As a result, a sound-pressure-frequency characteristic extremely deteriorates.

In the conventional loudspeaker mentioned above, it is proposed to form the diaphragm or rib by coinjection molding, however, its characteristic is required to be further improved.

The present invention is directed to solve the problems pointed out above and aims to provide a high quality diaphragm having an excellent sound-pressure-frequency characteristic and a loudspeaker using the diaphragm.

SUMMARY OF THE INVENTION

The present invention provides a diaphragm for a loudspeaker having the following elements:

three or more thick parts of odd numbers formed radially from a center part to an outer periphery; and a semi thick part formed between the thick parts so as to become thinner gradually from the outer periphery to the center part.

Furthermore, the present invention provides a loudspeaker using the diaphragm mentioned above.

DETAILED DESCRIPTION OF PREFERRED EMBODIMENTS

A diaphragm for a loudspeaker of the present invention includes three or more thick parts of odd numbers formed radially from a center part to an outer periphery, and a semi thick part formed between the thick parts so as to become thinner gradually from the outer periphery to the center part. Thus, the diaphragm which can suppress divided resonance is obtained.

Further, the diaphragm of the present invention further includes a web shaped thin part at an inner part of the semi thick part of the diaphragm. As a result, the diaphragm which can suppress divided resonance becomes lighter.

Sill further, in the diaphragm of the present invention, the thick part and the semi thick part of the diaphragm are formed at a rear surface of the diaphragm. In short, a front surface of the diaphragm does not have a concavity or a convexity caused by the thick part and the semi thick part, so that disturbance of a phase of a sound wave, which is generated by vertical movement of diaphragm 11 in driving of the loudspeaker, can be prevented.

Yet further, the loudspeaker of the present invention is structured by using the diaphragm discussed above, so that the loudspeaker, which can suppress divided resonance and has an excellent sound-pressure-frequency characteristic, can be provided.

An exemplary embodiment of the present invention is described hereinafter with reference to FIGS. 1 through 4. Elements similar to those shown in the conventional art have the same reference marks, and the descriptions of those elements are omitted here. In addition, it is emphasized that the drawings are schematic views and do not show actual dimensional relations between respective elements.

EMBODIMENT

A different point between a loudspeaker of the present invention and a conventional loudspeaker is a structure of diaphragm 11. Diaphragm 11 is formed of main body 11*a* of the diaphragm and edge 11*b*. Main body 11*a* of the diaphragm has substantially equiangular seven thick parts 11*c* extending radially from a center part. Between thick parts 11*c*, semi thick part 11*d* which becomes thinner gradually from an outer periphery to the center part is formed, and substantially web shaped thin part 11*e* is formed at an inner part of the semi thick part.

Figure 3:
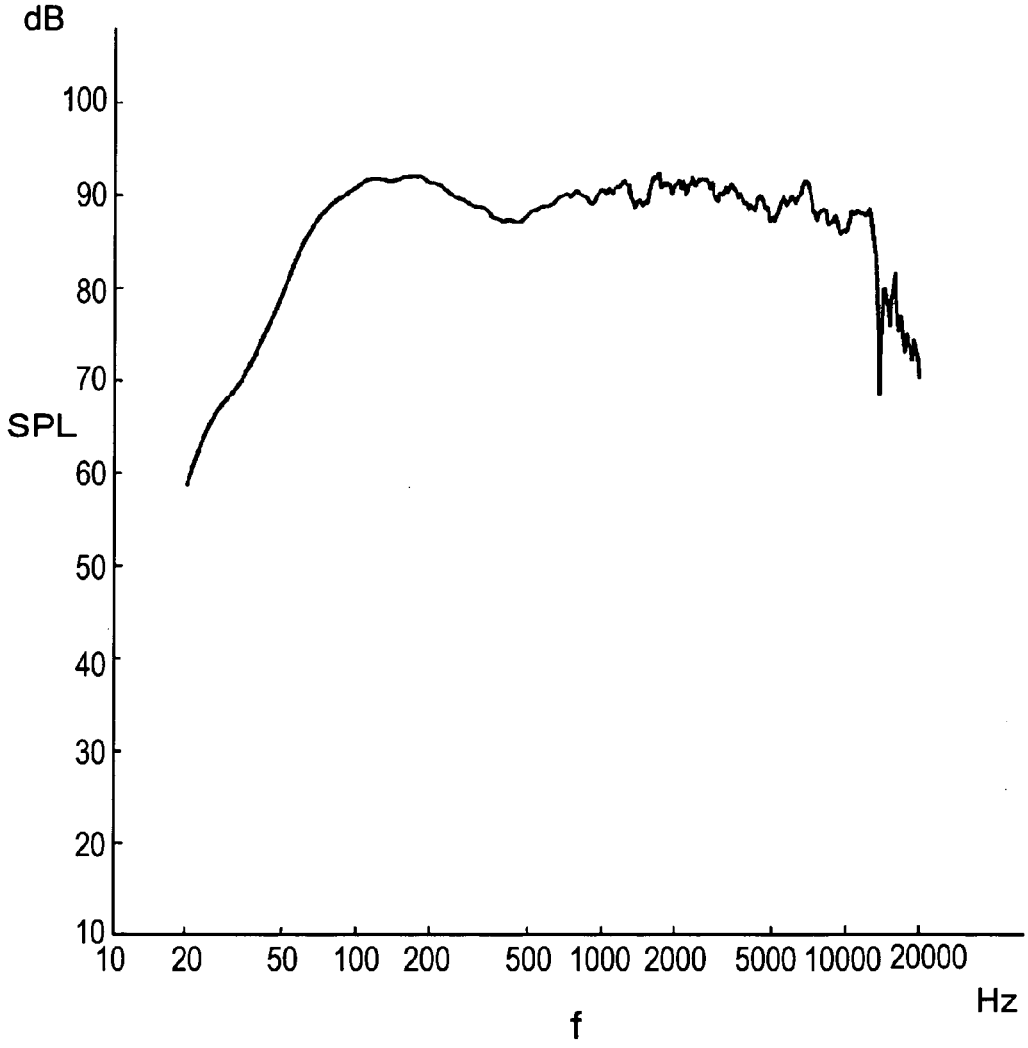
FIG. 3 is a sound-pressure-frequency characteristic of the loudspeaker using the diaphragm in accordance with the exemplary embodiment of the present invention.
Figure 4:
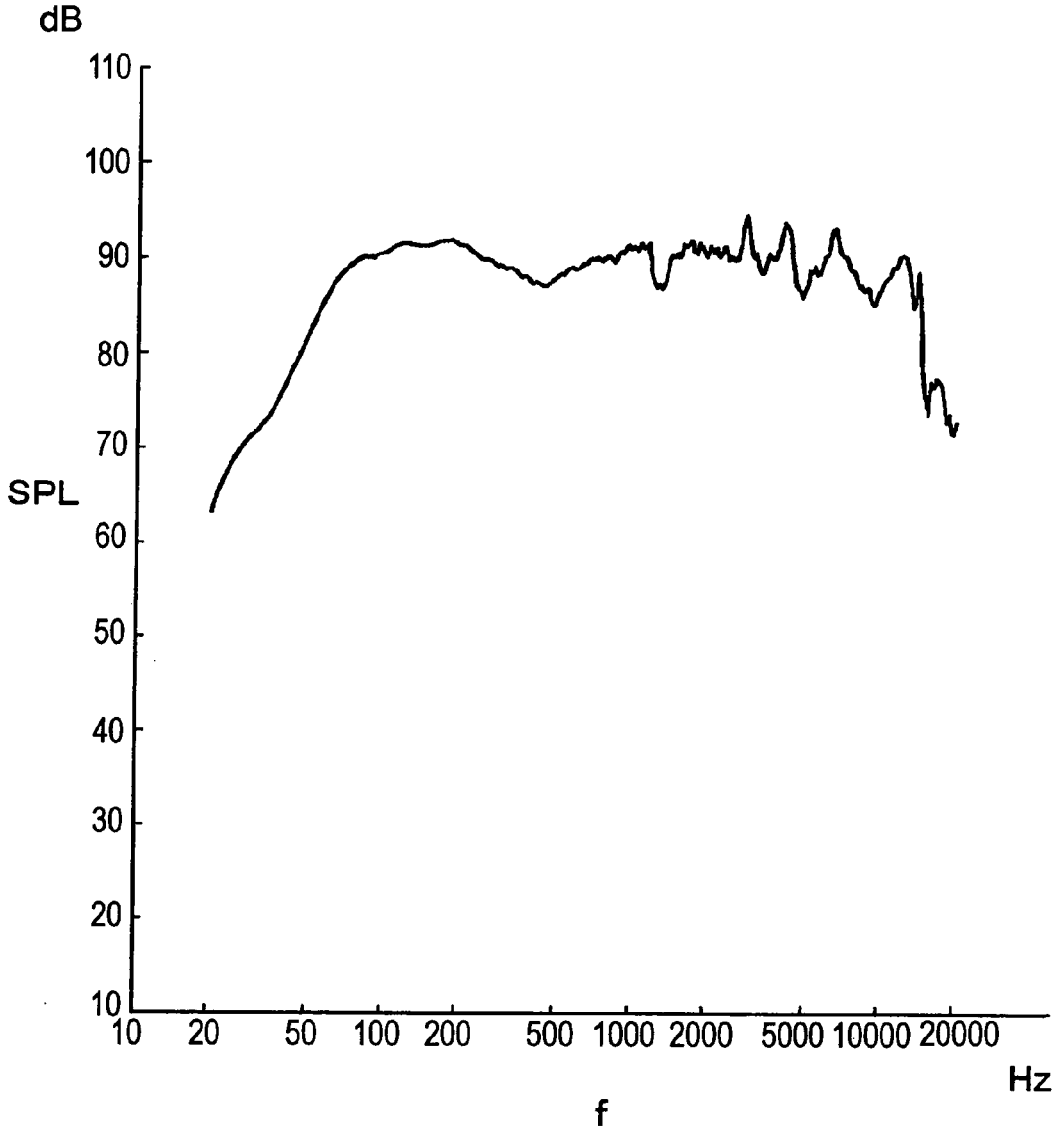
FIG. 4 is a sound-pressure-frequency characteristic of a loudspeaker using a conventional diaphragm.
Figure 5:
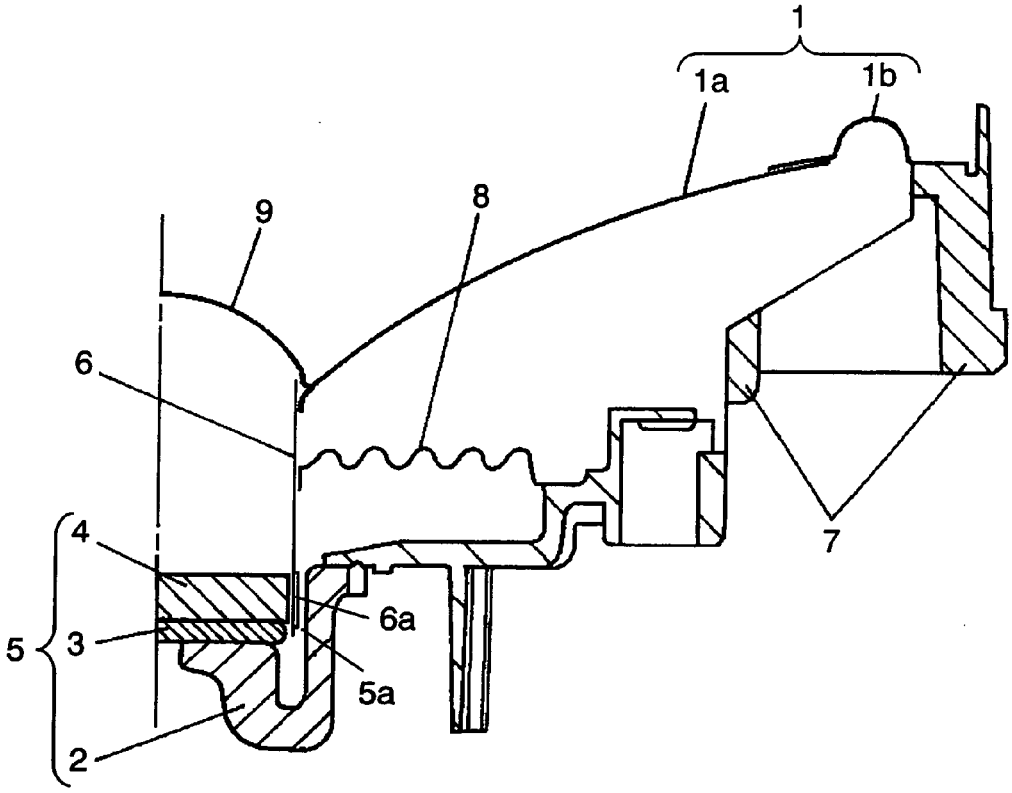
FIG. 5 PRIOR ART
FIG. 5 is a half sectional side view of the loudspeaker using the conventional diaphragm.
Figure 6:
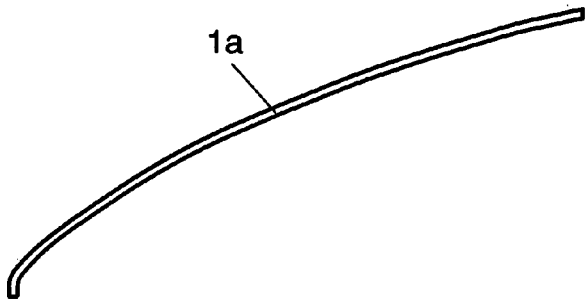
FIG. 6 PRIOR ART
FIG. 6 is a half sectional side view of the conventional diaphragm of the loudspeaker.
Figure 7:
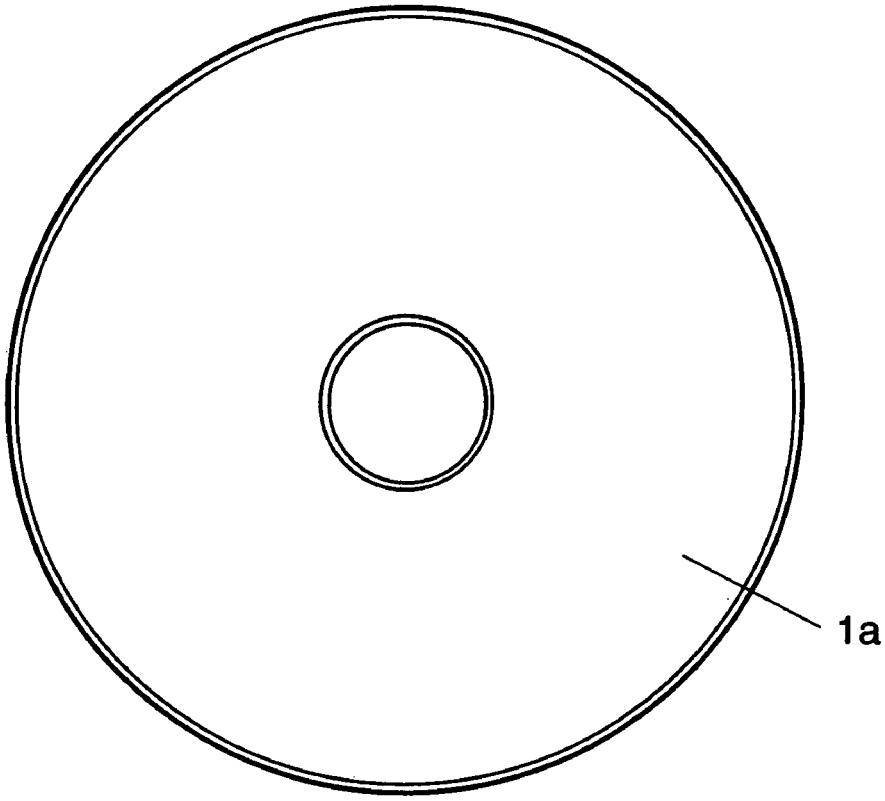
FIG. 7 PRIOR ART
FIG. 7 is a plan view of a main body of the conventional diaphragm of the loudspeaker shown from its bottom.

A sound-pressure-frequency characteristic of the loudspeaker using the diaphragm of the present embodiment and that using a conventional diaphragm are respectively shown in FIGS. 3 and 4. Each diameter of those loudspeakers is 16 cm and each material of the main bodies of the diaphragms is polypropylene.

Polymethylpentene, polyamide, polyphenylene ether, ABS, PBT, blended material thereof, alloyed material thereof, or the like is used as the material of the main body of the diaphragm.

The main body of the conventional diaphragm is made by resin molding of an average thickness "t"=0.2 mm. Main body 11*a* of the diaphragm of the present embodiment is made by resin molding in such a manner that an average thickness "t"=0.25 mm at thick part 11*c* and an average thickness "t"=0.15 mm at thin part 11*e*.

As shown in FIGS. 3 and 4, the sound-pressure-frequency characteristic of the loudspeaker of the present embodiment shows extremely reduced disturbance and stable characteristic at frequency bands not lower than 1 kHz.

This is because the main body of the diaphragm is formed asymmetry by thick part 11*c* of odd numbers, so that an axisymmetrical part is not formed, and besides, semi thick part 11*d* is formed. In a word, flexural rigidity from a center of main body 11*a* of the diaphragm to an outer part improves, so that divided vibration of natural resonance mode is suppressed. In addition, divided vibration of natural resonance generated in a circumference direction is also suppressed by semi thick part 11*d*.

Furthermore, main body 11*a* of the diaphragm becomes lighter by thinning without deteriorating rigidity of web shaped thin part 11*e* which is a part excluding thick part 11*c* and semi thick part 11*d*.

If rib shaped thick part is merely formed, fluidity deteriorates with another thin part in molding (injection molding). Thus, weld is generated, and not only an outward appearance but also a sound-pressure-frequency characteristic is adversely affected. On the other hand, according to the present embodiment, fluidity in injection molding improves by semi thick part 11*d* which becomes thinner gradually from the outer periphery to the center part. As a result, generation of weld is suppressed, and deterioration of an outward appearance or characteristics mentioned above, which is caused by fluidity in molding, is also suppressed.

In addition, diaphragm 11 can be lighter by making thick part 11*c* gradually thin to the outer periphery.

Still further, according to the present embodiment, seven thick parts 11*c* are discussed, however, on condition that substantially equiangular three or more thick parts of odd numbers formed, the number of thick part 11*c* can be set optionally based on a shape of a loudspeaker or a diaphragm.

According to the present embodiment, thick part 11*c* and semi thick part 11*d* are not formed at a front surface of main body 11*a* of the diaphragm, but formed at a rear surface of diaphragm 11. A concavity and a convexity are not formed at the front surface, so that disturbance of a phase of a sound wave, which is generated by vertical movement of diaphragm 11 in driving of the loudspeaker for sounding, can be prevented.

Figure 1:
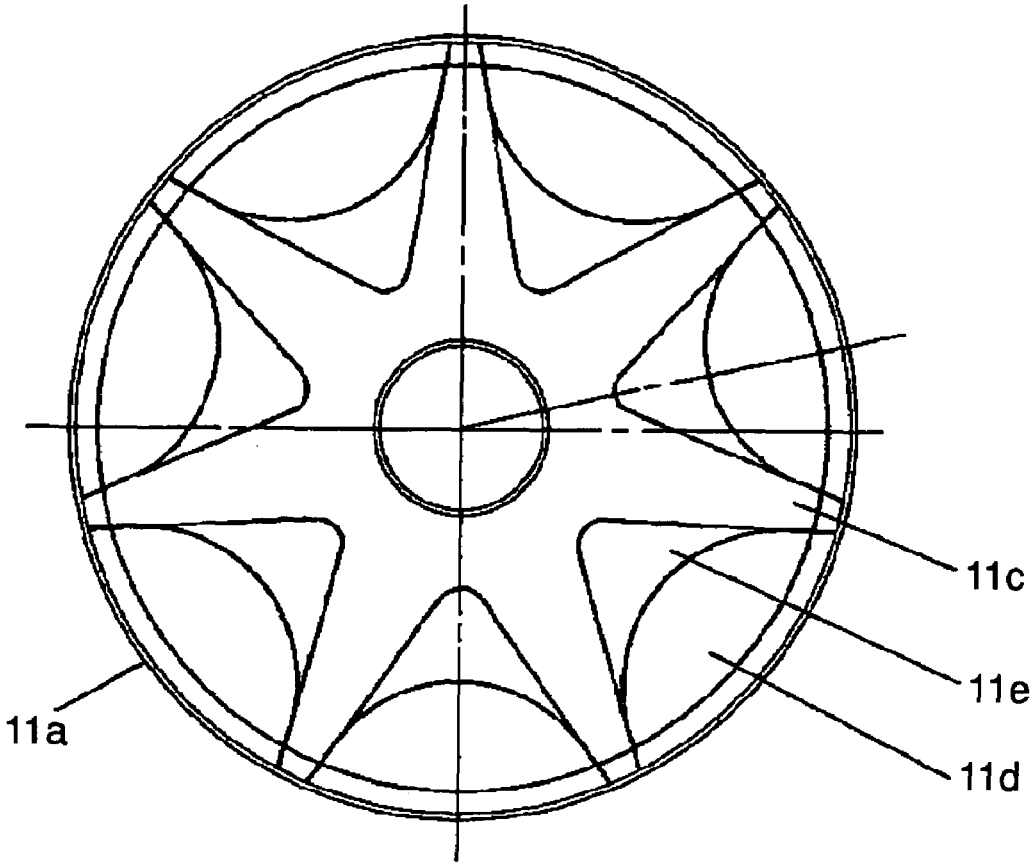
FIG. 1 is a plan view of a main body of a diaphragm shown from its bottom in accordance with an exemplary embodiment of the present invention.
Figure 2:
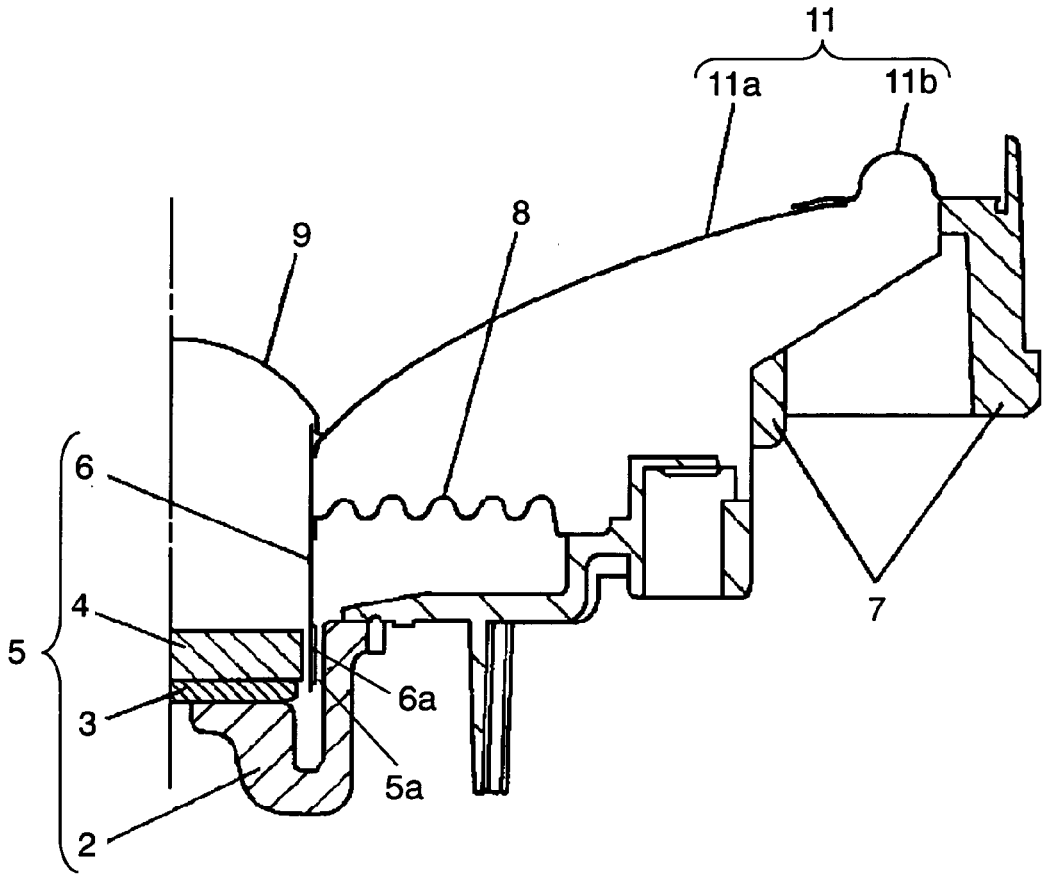
FIG. 2 is a half sectional side view of a loudspeaker using the diaphragm in accordance with the exemplary embodiment of the present invention.

According to the present embodiment, thin part 11*e* is discussed as substantially web shape which is an arc shape directing from an outer periphery to an inward as shown in FIG. 1. By making semi thick part 11*d* larger mentioned above, possibility of generation of weld decreases in molding main body 11*a* of the diaphragm.

In a case where thin part 11*e* is formed as an arc shape directing from the center to the outer periphery, thin part 11*e* becomes larger (not shown), so that possibility of generation of weld increases more than that of the present embodiment. However, the diaphragm becomes lighter. As discussed above, a form of web shape of thin part 11*e* can be set optionally based on material, thickness or the like of main body 11*a* of the diaphragm.

As discussed above, the diaphragm of the present invention can provide an excellent diaphragm for a loudspeaker which can suppress divided resonance.

A high quality loudspeaker can be provided by using this diaphragm.

INDUSTRIAL APPLICABILITY

A diaphragm and a loudspeaker using the diaphragm of the present invention are widely applied to devices, where a loudspeaker is to be mounted, such as various acoustic devices (e.g., in-car acoustic devices).

The invention claimed is:

1. A diaphragm for a loudspeaker comprising:

an odd number of three or more thick parts extending radially from a center part to an outer periphery; and interlevel parts formed between the thick parts, wherein a thickness of the interlevel parts between the thick parts gradually decreasing from the outer periphery to the center part.

2. The diaphragm for a loudspeaker of claim 1, wherein the interlevel parts between the thick parts includes a thin part at an inner part thereof.

3. The diaphragm for a loudspeaker of claim 1, wherein the thick parts are are formed at a rear surface of the diaphragm and a front surface of the diaphragm is neither convex nor concave.

4. A loudspeaker comprising:

a magnetic circuit;

a frame coupled with the magnetic circuit;

a voice coil held in a magnetic gap formed at the magnetic circuit; and a diaphragm whose inner periphery is coupled with the voice coil and outer periphery is coupled with the frame via an edge;

wherein the diaphragm includes an odd number of three or more thick parts extending radially from a center part to an outer periphery, and interlevel parts between the thick parts, a thickness of the interlevel parts between the thick parts becomes gradually decrease from the outer periphery to the center part.

5. The loudspeaker of claim 4, wherein the interlevel parts between the thick parts each includes a constant thickness portion at an inner part thereof.

* * * * *